US007427962B2

(12) United States Patent
Yang

(10) Patent No.: US 7,427,962 B2
(45) Date of Patent: Sep. 23, 2008

(54) BASE STATION ANTENNA ROTATION MECHANISM

(75) Inventor: Ching-Shun Yang, Naperville, IL (US)

(73) Assignee: Andrew Corporation, Westchester, IL (US)

( * ) Notice: Subject to any disclaimer, the term of this patent is extended or adjusted under 35 U.S.C. 154(b) by 79 days.

(21) Appl. No.: 11/406,151

(22) Filed: Apr. 18, 2006

(65) Prior Publication Data

US 2007/0241979 A1 Oct. 18, 2007

Related U.S. Application Data

(63) Continuation-in-part of application No. 11/399,627, filed on Apr. 6, 2006, which is a continuation-in-part of application No. 10/312,979, filed on Jun. 16, 2003.

(51) Int. Cl.
*H01Q 3/00* (2006.01)

(52) U.S. Cl. ..... 343/757

(58) Field of Classification Search ..... 343/756–758, 343/812–818, 880, 761–766
See application file for complete search history.

(56) References Cited

U.S. PATENT DOCUMENTS 4,124,852 A 11/1978 Steudel
4,197,548 A * 4/1980 Smith et al. ..... 343/765
4,445,119 A 4/1984 Works
4,815,339 A * 3/1989 Bonadies et al. ..... 74/813 L
4,827,270 A 5/1989 Udagawa et al.
5,115,248 A 5/1992 Roederer
5,151,706 A 9/1992 Roederer et al.
5,223,845 A * 6/1993 Eguchi ..... 342/359
5,333,001 A 7/1994 Profera, Jr.
5,596,329 A 1/1997 Searle et al.
5,619,215 A * 4/1997 Sydor ..... 343/766
5,734,349 A 3/1998 Lenormand et al.
5,818,385 A 10/1998 Bartholomew
5,949,370 A 9/1999 Smith et al.
5,969,689 A * 10/1999 Martek et al. ..... 343/758
6,078,824 A 6/2000 Sogo
6,097,267 A 8/2000 Hampel
6,198,458 B1 3/2001 Heinz et al.
6,239,744 B1 5/2001 Singer et al.

(Continued)

FOREIGN PATENT DOCUMENTS

CA 2220745 8/1998

(Continued)

*Primary Examiner*—Huedung Mancuso
(74) *Attorney, Agent, or Firm*—Husch Blackwell Sanders Welsh & Katz

(57) ABSTRACT

A base station antenna system producing a beam, includes an array antenna rotatably mounted with respect to an antenna support so as to permit azimuth steering of the antenna beam and an azimuth position rotation arrangement configured to rotate the array antenna with respect to the antenna support about an antenna axis. The rotation arrangement further includes an actuator mounted on the antenna support having an operator adapted to move linearly along an operator motion axis parallel to the antenna axis when the actuator is energized. A motion converter is coupled between the actuator and the array antenna, wherein linear movement of the operator along said operator motion axis produces rotary movement of the antenna about the parallel antenna axis.

9 Claims, 15 Drawing Sheets

U.S. PATENT DOCUMENTS

| | | | | |
|---|---|---|---|---|
| 6,246,674 | B1 | 6/2001 | Feuerstein et al. | |
| 7,015,871 | B2 * | 3/2006 | Gottl et al. | 343/882 |
| 2004/0038714 | A1 | 2/2004 | Rhodes et al. | |

FOREIGN PATENT DOCUMENTS

| | | | |
|---|---|---|---|
| CA | 2333922 | | 6/1999 |
| EP | 0 543 509 | B1 | 7/1998 |
| EP | 0 600715 | B1 | 1/1999 |
| EP | 1 032 074 | | 8/2000 |
| EP | 0 984 508 | A3 | 8/2001 |
| GB | 2 288 913 | A | 11/2000 |
| WO | 96/14670 | | 5/1996 |
| WO | 01/03414 | | 1/2001 |
| WO | 01/06595 | | 1/2001 |
| WO | 02/37605 | | 5/2002 |
| WO | 02/47207 | | 6/2002 |

* cited by examiner

BASE STATION ANTENNA ROTATION MECHANISM

CROSS-REFERENCE TO RELATED APPLICATIONS

This is a continuation-in-part of, and claims the benefit of priority from application Ser. No. 11/399,627 filed Apr. 6, 2006, entitled "A Cellular Antenna And Systems and Methods Therefor," and currently pending, which is a continuation-in-part of, and claims the benefit of priority from application Ser. No. 10/312,979, filed Jun. 16, 2003 (PCT Filing Date), entitled "Cellular Antenna," and currently pending.

FIELD OF THE INVENTION

This invention relates to a cellular antenna and systems incorporating the antenna as well as electromechanical structure to facilitate azimuth rotation of the antenna.

BACKGROUND OF THE INVENTION

The applicant's prior application US2004/0038714A1 (Rhodes), the disclosure of which is incorporated by reference, discloses an antenna system providing remote electrical beam adjustment for down tilt, beam width and azimuth.

Systems for effecting mechanical adjustment of antenna beam azimuth are known but have not been well integrated into a cellular antenna. Whilst Rhodes discloses integrated antenna systems providing electrical attribute adjustment (e.g. down tilt, azimuth and beam width) there is a need for an antenna providing good integration of mechanical and electrical attribute adjustment.

Further, electrical adjustment of azimuth without mechanical movement is possible using phase shifting of the various signals routed to the radiating elements. However, to do so, multiple columns of radiators are needed to produce a beam electrically moveable in azimuth without mechanical movement of the entire antenna or antenna backplane. For antennas having a single column of radiators, electrical azimuth adjustment is not feasible, and mechanical means must be used.

Single column antennas having electrical actuators, such as motors, are subject to very tight space and dimensional requirements, as the amount of room between the backplane and the radome and between the backplane and the enclosure and supporting structure is minimal. Accordingly, it is difficult to mount an electrical actuator, such as a motor and drive assembly within the space dictated by the antenna package.

Exemplary Embodiments

There is provided an antenna allowing mechanical azimuth adjustment in combination with adjustment of one or more other antenna attribute. An integrated control arrangement is provided which can utilize either serial, wireless or RF feed lines to convey communications. Systems incorporating such antennas and methods of controlling them are also provided. A number of embodiments are described and the following embodiments are to be read as non-limiting exemplary embodiments only.

According to one exemplary embodiment there is provided a cellular antenna comprising: an array antenna rotatably mountable with respect to an antenna support so as to enable azimuth steering of the beam of the antenna; an azimuth position actuator configured to rotate the array antenna with respect to an antenna support; and an actuator controller configured to receive control data associated with an address assigned to the actuator controller over an addressable serial bus and to control the azimuth position actuator in accordance with azimuth control data received.

According to another exemplary embodiment there is provided a network management system comprising a plurality of base station antenna sites, each with a group of antenna systems as described above.

According to another exemplary embodiment there is provided a cellular antenna comprising: an array antenna rotatably mountable with respect to an antenna support so as to enable azimuth steering of the beam of the antenna having a first array of radiating elements for operation over a first frequency band and a second array of radiating elements for operation over a second frequency band; an azimuth position actuator configured to rotate the array antenna with respect to an antenna support; a first feed network configured to supply signals to and receive signals from the first array of radiating elements including an azimuth phase shifter to vary the phase of signals passing through the feed network; an azimuth phase shifter actuator configured to adjust the azimuth phase shifter; and an actuator controller configured to receive control data and to control the azimuth position actuator in accordance with mechanical azimuth control data received to rotate the array antenna with respect to an antenna support to alter the direction of the antenna and to control the azimuth phase shifter actuator in accordance with electrical azimuth control data received to adjust the azimuth beam direction of the first array with respect to the azimuth beam direction of the second array.

According to another exemplary embodiment there is provided a method of adjusting beam azimuth for a multiband antenna having a first array and a second array in which the first array has a feed network including one or more variable element for adjusting beam azimuth, the method comprising: mechanically orienting the antenna so as to achieve a desired azimuth beam direction for the second array; and setting the variable element so as to achieve a desired beam azimuth for the first array, different to the beam azimuth for the first array.

According to another alternate embodiment, there is provided a base station antenna system producing a beam, including an array antenna rotatably mounted with respect to an antenna support so as to permit azimuth steering of the antenna beam, and an azimuth position rotation arrangement configured to rotate the array antenna with respect to the antenna support about an antenna axis, the rotation arrangement further including an actuator mounted on the antenna support and having an operator adapted to move linearly along an operator motion axis parallel to the antenna axis when the actuator is energized. Also included is a motion converter coupled between the actuator and the array antenna, wherein linear movement of the operator along the operator motion axis produces rotary movement of the antenna about the parallel antenna axis.

According to still another alternate embodiment, there is provided a base station antenna system producing a beam, including an array antenna rotatably mounted with respect to an antenna support so as to permit azimuth steering of the antenna beam, and an azimuth position rotation arrangement configured to rotate the array antenna with respect to the antenna support about an antenna axis, the rotation arrangement further including an actuator mounted on the antenna support and having an operator adapted to move linearly along an operator motion axis parallel to the antenna axis when the actuator is energized. Also included is a motion converter coupled between the actuator and the array antenna, wherein linear movement of the operator along the operator motion axis produces rotary movement of the antenna about the parallel antenna axis. In this embodiment, the actuator need not necessarily be mounted on the antenna support. Rather, the actuator may be mounted on the rotatable array antenna while the motion converter may be fixedly mounted on the antenna support.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

FIG. 2*a* shows a schematic side view of an antenna according to a third embodiment;

DETAILED DESCRIPTION OF THE INVENTION

Attributes of an antenna beam may be adjusted by physically orienting an antenna or by adjusting the variable elements in an antenna feed network. Physically adjusting the orientation of an antenna mechanically maintains a better radiation pattern for the antenna beam than by adjusting a variable element in the feed network. For down tilt a better radiation pattern is obtained by adjusting a variable element in the feed network than by mechanically orienting the antenna.

Figure 1:
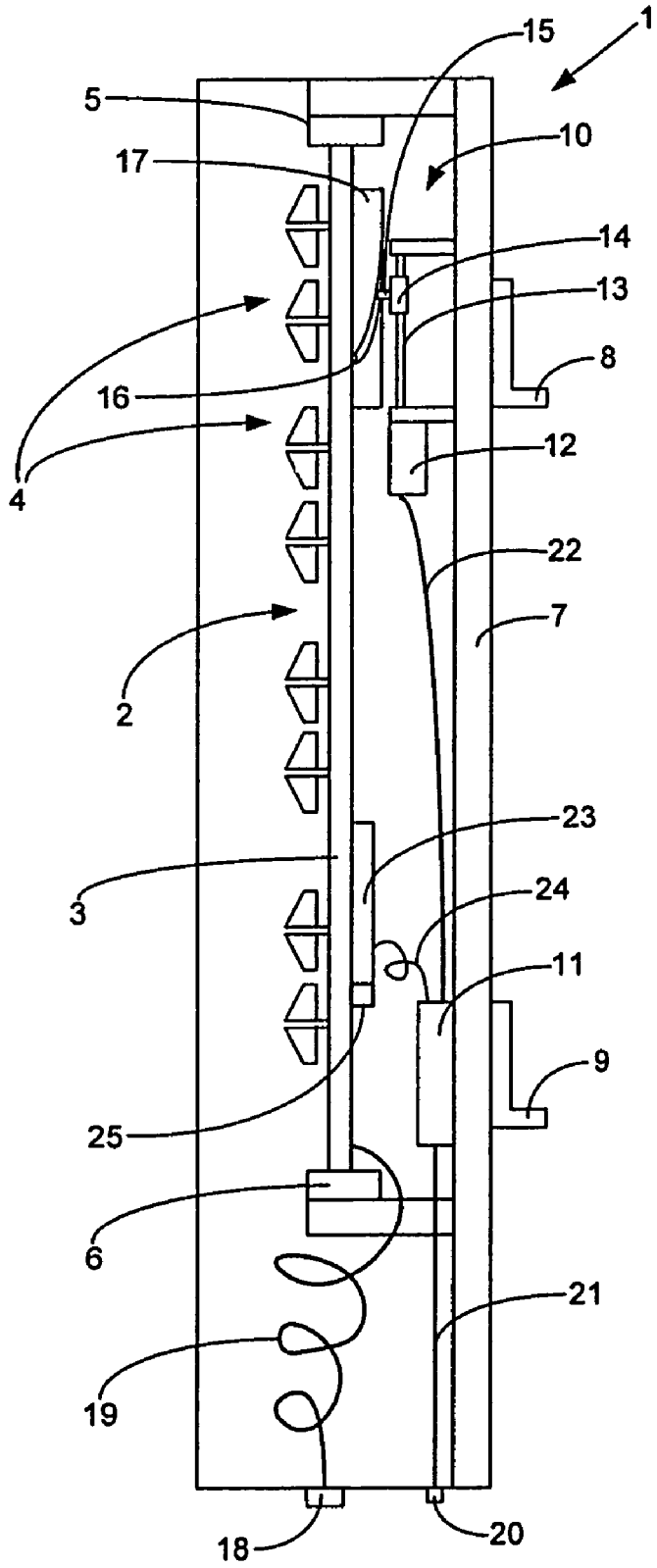
FIG. 1 shows a schematic side view of an antenna according to a first embodiment.

FIG. 1 shows a side view of a cellular antenna 1 according to a first embodiment. Antenna 1 includes an array antenna 2 having a reflector 3 and a plurality of radiating elements 4 (only some of which are indicated and the number of which may vary). Reflector 3 is rotatable about bearings 5 and 6 so that the array antenna 2 can rotate with respect to antenna support 7. Mounting brackets 8 and 9 allow the antenna to be mounted to a support structure such as a tower.

An azimuth position actuator 10 rotates array antenna 2 with respect to antenna support 7 in response to drive signals from actuator controller 11. Azimuth position actuator 10 includes a geared motor 12 driving a threaded shaft 13 which drives a nut 14 up and down as it rotates. Nut 14 has a pin 15 projecting therefrom which locates within a helical groove 16 in semi cylindrical guide 17. As pin 15 moves up and down guide 17 causes the array antenna 2 to rotate about its vertical axis to provide mechanical azimuth steering. It will be appreciated that a range of mechanical drive arrangements could be employed, such as geared drive trains, crank arrangements, belt and pulley drives etc.

In the embodiment shown in FIG. 1 an RF feed is supplied to connector 18 and a coiled feed line 19 supplies the RF feed to antenna array 2. In this embodiment control signals are provided to serial bus connector 20 and supplied to controller 11 via cable 21. Actuator controller 11 controls azimuth position actuator motor 12 via cable 22 and controls one or more actuator adjusting one or more variable element contained within variable feed assembly 23 via cable 24. Both cables 19 and 24 have excess length to enable ease of rotation of antenna array 2.

Variable feed assembly 23 may include a single phase shifter or multiple phase shifters to adjust down tilt. Variable feed assembly 23 may additionally or alternatively include one or more phase shifter or power divider to effect beam width adjustment. Variable feed assembly 23 may also include one or more phase shifter to effect electrical azimuth adjustment. Electrical azimuth adjustment may be provided for a multiband antenna so that the azimuth of the antenna beam of a first array may be adjusted mechanically and the antenna beam of a second array may be adjusted electrically to achieve a desired offset.

Actuator controller 11 may receive status and configuration information from variable feed assembly 23 such as the current position of phase shifters or power dividers or whether an actuator has a fault condition etc. A compass 25 may also be provided to give a real-time measurement as to the azimuth orientation of antenna array 2. The basic reading may be adjusted with respect to true North at the place of installation. This status and configuration information may be supplied from actuator controller 11 to a base station auxiliary equipment controller via a serial cable connected to connector 20.

In use serial data received by actuator controller 11 will include an address for an actuator controller along with data specifying desired operating parameters. When actuator controller 11 receives data associated with its address it controls actuators in accordance with control data for an attribute to be controlled. For example, actuator controller 11 may receive data for mechanical azimuth with a value of 222 degrees. Controller 11 obtains orientation information from compass 25 and drives motor 12 so as to rotate antenna 2 until the compass reading from compass 25 corresponds with the desired orientation. Likewise, controller 11 may receive data for a required down tilt angle. A down tilt phase shifter actuator, such as a geared motor, may drive one or more phase shifter in the feed network until an associated position sensor communicates to actuator controller 11 that the desired phase shifter position has been achieved (see U.S. Pat. No. 6,198,458, the disclosure of which is incorporated by reference). Likewise, beam width actuators and azimuth actuators may be driven by actuator controller 11 to achieve desired values.

In this way actuator controller 11 can control mechanical azimuth and electrical azimuth, down tilt and beam width in response to commands received from a addressable serial bus.

Figure 2A:
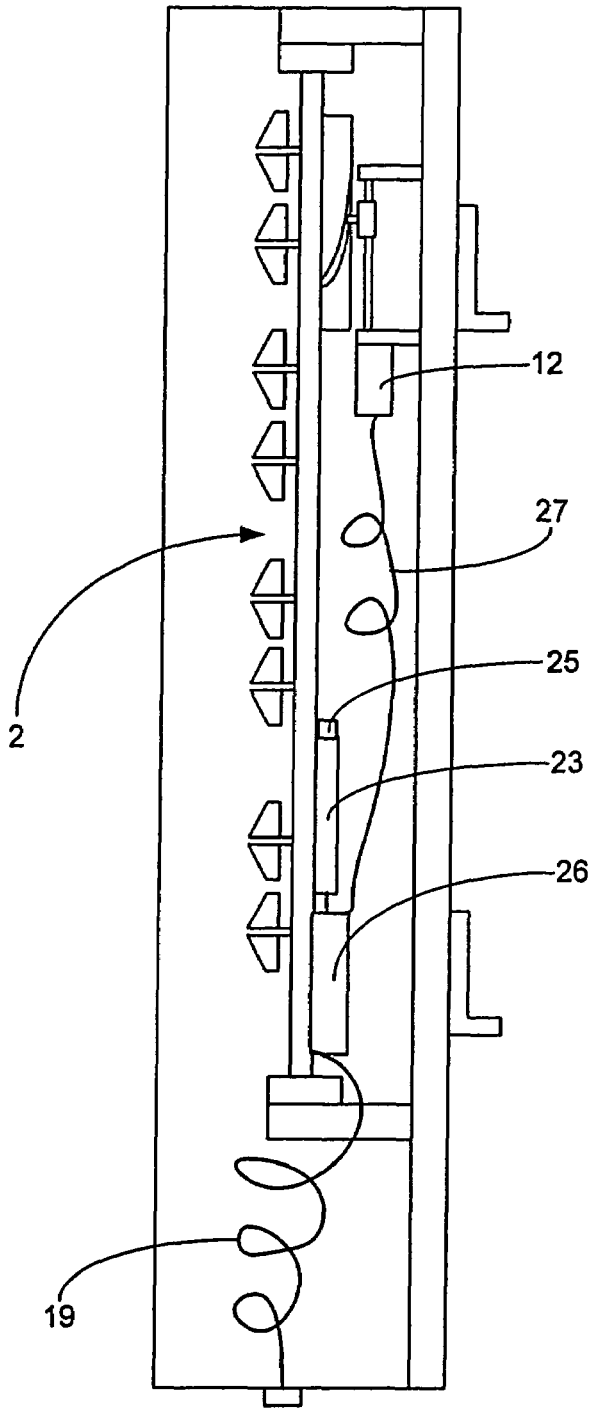
FIG. 2*a* shows a schematic side view of an antenna according to a second embodiment.

FIG. 2*a* shows a second embodiment in which all RF signals and control data are received over a single RF feed line. Like integers had been given like numbers to those shown in FIG. 1. In this embodiment RF feed line 19 supplies RF feed signals to antenna interface 26 which supplies RF signals to variable feed assembly 23 and extracts and supplies control data to actuator controller 23. As antenna interface 26 is mounted to reflector 3 a flexible control cable 27 is provided to azimuth motor 12. Antenna interface 26 may extract power supplied by an RF feed line to operate actuator controller 23 and it associated actuators. A DC bias voltage may be applied to the RF feed line at the base of a cellular base station tower and extracted by antenna interface 26 at the top of the tower. This arrangement has the advantage that only a single RF feed line need be connected to each antenna to provide both RF signals and control data.

Figure 2B:
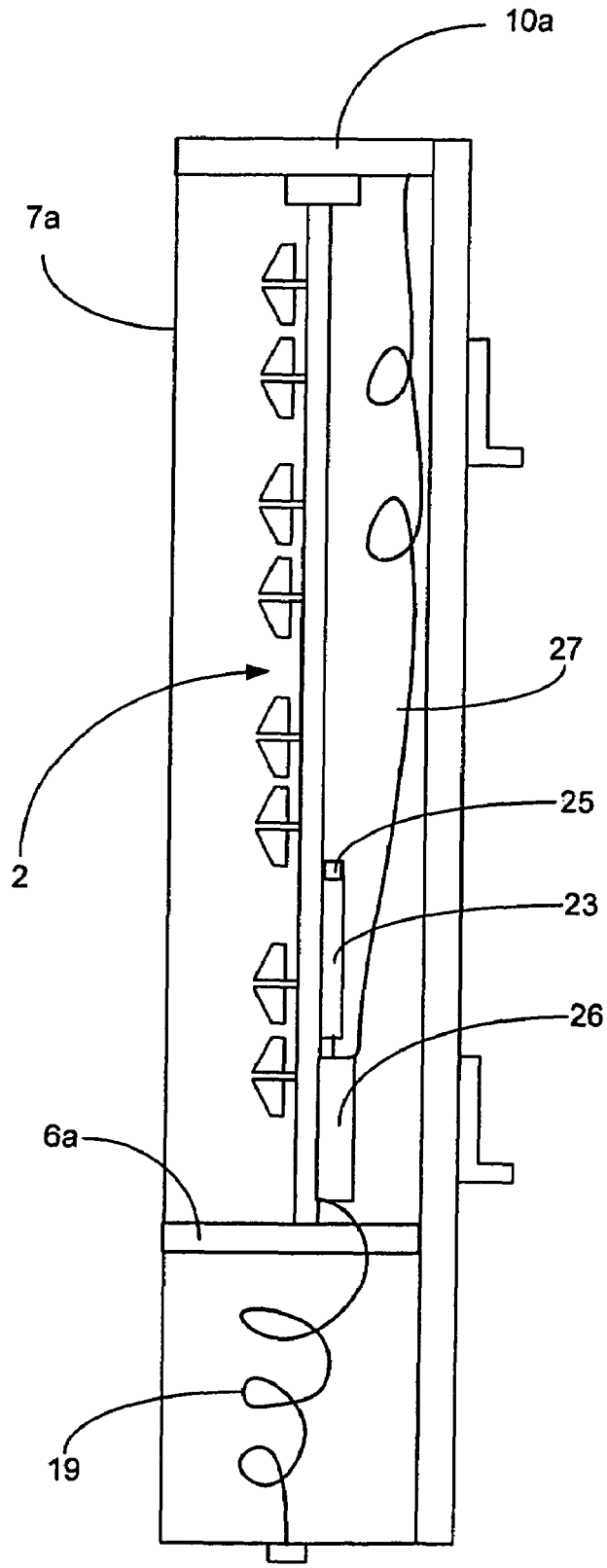

FIG. 2*b* shows a variant of the embodiment shown in FIG. 1 where the azimuth position actuator 10*a* is in the form of a top mounted geared motor which supports antenna 2 and rotates it. The base of the antenna is maintained in position by bearing 6*a* secured to the base of the antenna and extending to the walls of the radome 7*a*.

Figure 3A:
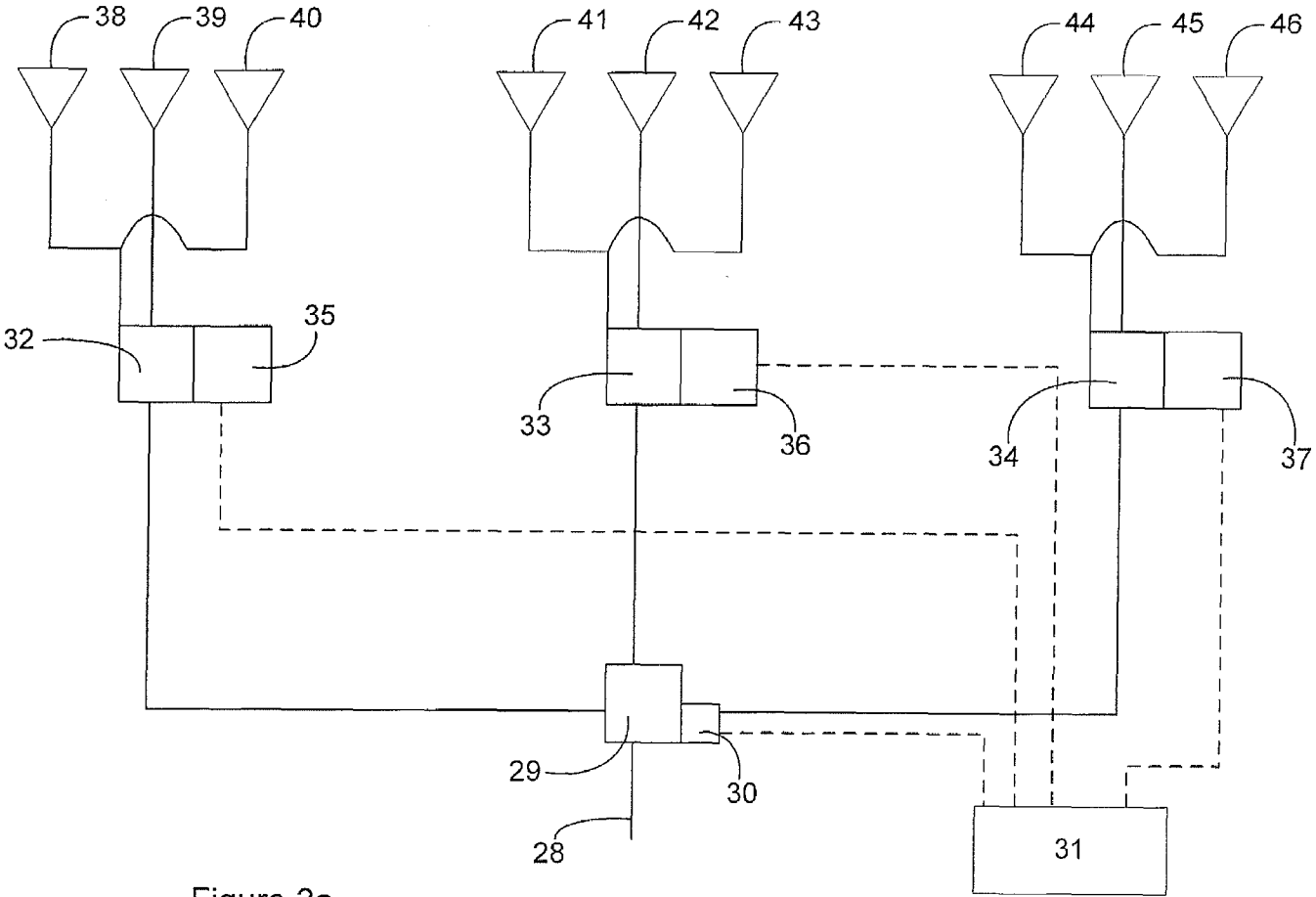
FIG. 3*a* shows a schematic view of a feed arrangement for an antenna of the type shown in FIGS. 1 and 2.

Referring now to FIG. 3 there is shown a feed arrangement suitable for adjusting the down tilt and the beam width of the beam of an antenna of the type shown in FIGS. 1 and 2. In this case the antenna includes three rows 38 to 40, 41 to 43 and 44 to 46 of radiating elements although it will be appreciated that any desired number may be employed. RF feed line 28 feeds differential phase shifter 29. Actuator 30 is driven by actuator controller 31 to adjust the position of the variable differential phase shifter 29 to achieve a desired beam down tilt. Actuators 35 to 37 are driven by controller 31 to adjust power dividers 32 to 34 to adjust antenna beam width.

Figure 9:
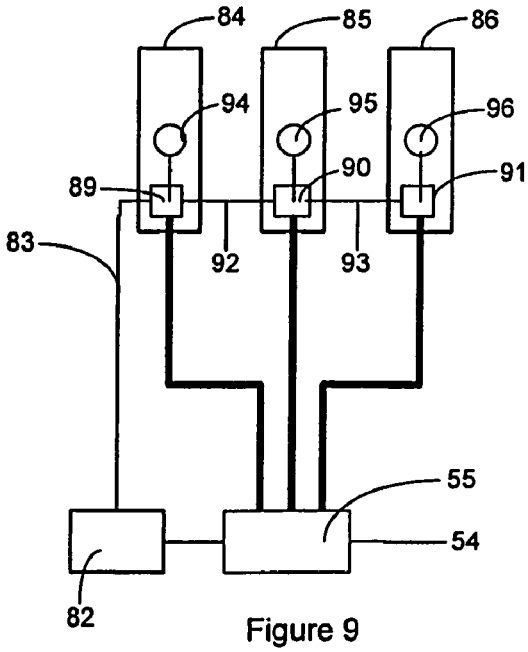
FIG. 9 shows a schematic diagram of a data communications arrangement for the cellular base station shown in FIG. 8.

A number of feed arrangements utilizing variable elements may be employed, some examples of which are set out in US2004/0038714A1 which is incorporated herein by reference. FIG. 9 in particular shows an embodiment including a down tilt phase shifter driven by a down tilt phase shifter actuator, power dividers driven by power divider actuators and azimuth phase shifters driven by azimuth phase shifter actuators to effect down tilt, beam width and azimuth adjustment of the antenna beam. It will be appreciated that any one or combination of attributes may be adjusted depending upon the application. In a simple application electrical down tilt adjustment may be provided with mechanical azimuth adjustment.

Figure 3B:
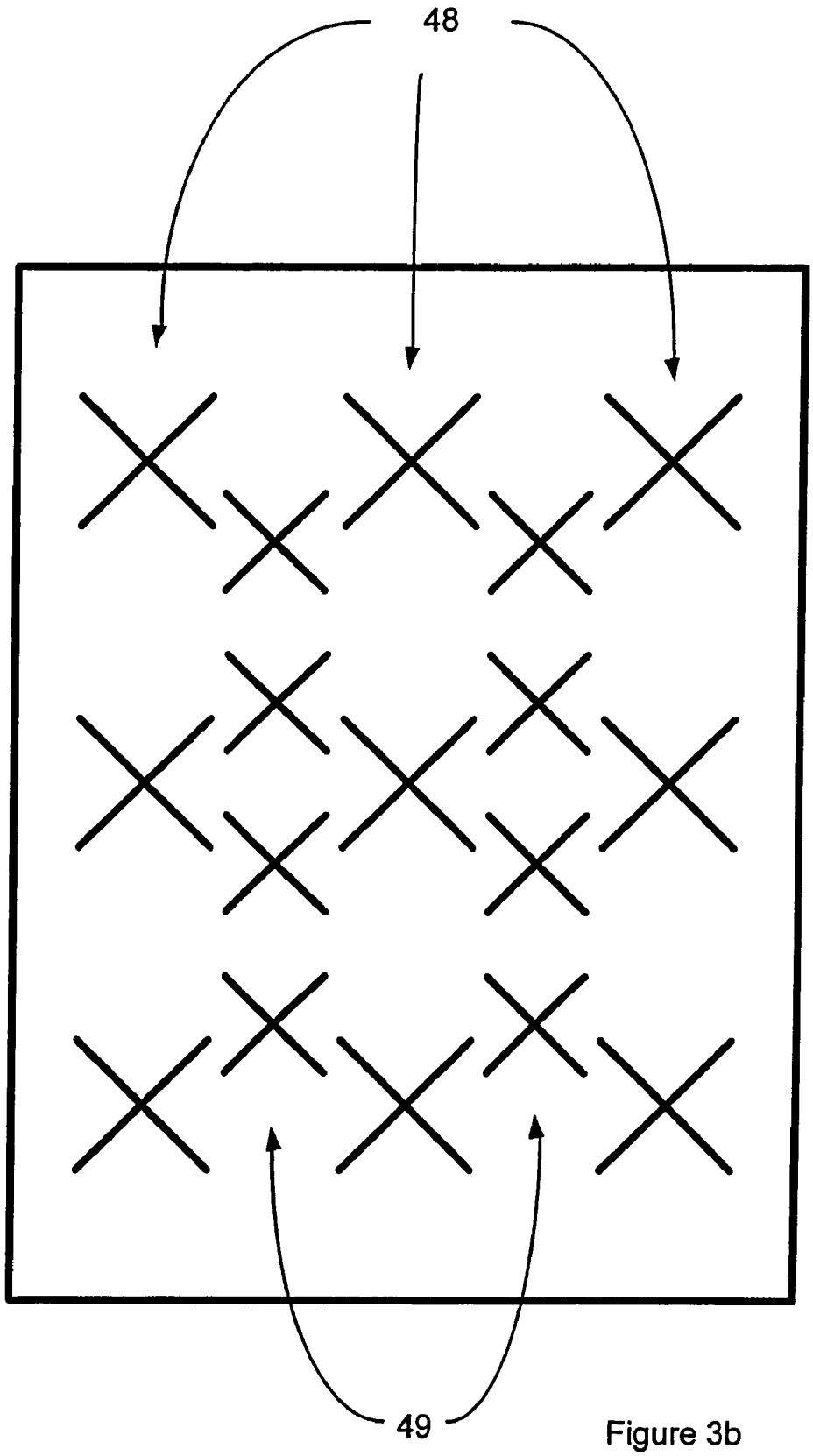
FIG. 3*b* shows a schematic view of a multiband antenna embodiment.

In the multi-array embodiment shown in FIG. 3*b* a first array of columns of radiating elements 48 may have a feed network as shown in FIG. 3 whilst the second array of columns of radiating elements 49 may have a feed network as shown in FIG. 9 of US2004/0038714A1. In this way the beam direction for the first array may be set mechanically by mechanically orienting the antenna and the beam direction for the second array may be offset using electrical azimuth adjustment in the feed network. The arrays may operate in the same or different frequency bands. In the embodiment shown in FIG. 3*b* array 49 operates in a higher band than array 48.

Figure 4:
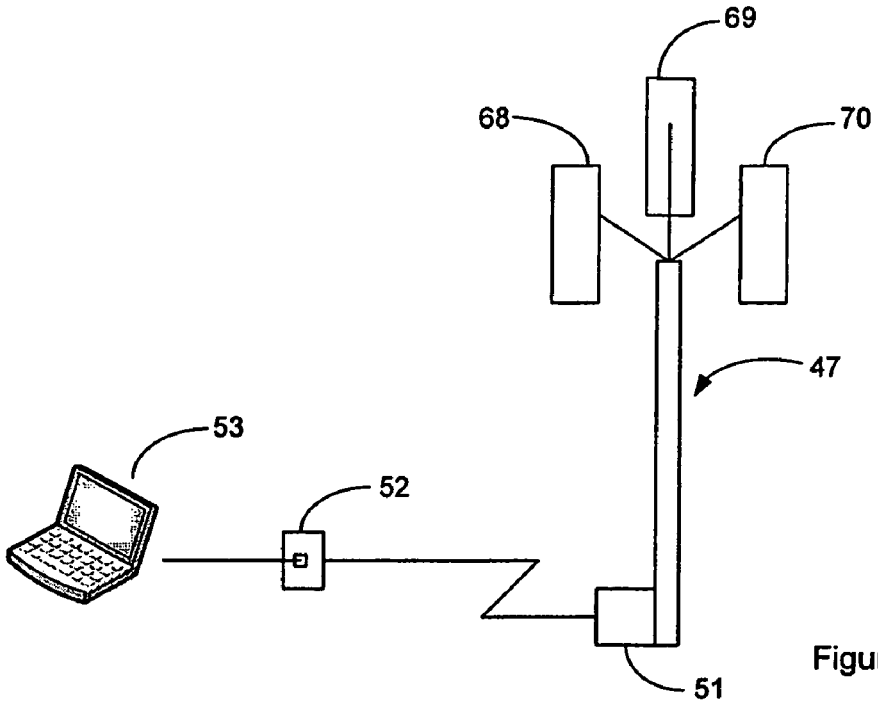
FIG. 4 shows a schematic diagram of a cellular base station in which control data is sent via one or more RF feed line.

Referring now to FIG. 4 a schematic diagram of an antenna base station 47 having three antennas 68, 69 and 70 is shown. Auxiliary equipment controller 51 includes a connector 52 allowing a laptop 53 to interface with base station auxiliary equipment controller 51.

Figure 5:
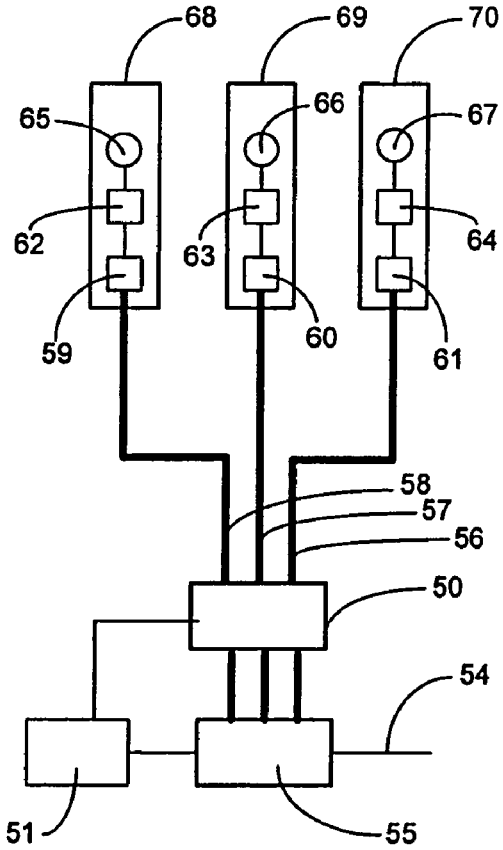
FIG. 5 shows a schematic diagram of a first data communications arrangement for the cellular base station shown in FIG. 4.

FIG. 5 shows a first embodiment in which a base station controller 55 communicates with a central controller via a backhaul link 54. Commands for controlling antenna attributes are sent from base station controller 55 to auxiliary equipment controller 51. A modulation/demodulation arrangement conveys commands between control interface 50 and antenna interfaces 59 to 61. Base station controller 55 sends RF signals for transmission via RF feed lines 57 to control interface 50. Auxiliary equipment controller 51 sends commands for controlling controllable antenna elements to control interface 50 which superposes control commands onto RF feed lines 56 to 58. Each antenna includes an antenna interface 59 to 61 which extracts the superposed control commands and provides these to controller actuators 62 to 64 which control actuators 65 to 67 of antennas 68 to 70. It will be appreciated that any number of actuators may be controlled and that these may include control motors to adjust the physical position of an antenna, actuators to adjust phase shifters, actuators to adjust power dividers or other adjustable elements. The control data will include an address for an actuator controller along with control data designating the attribute to be controlled (e.g. down tilt) and a desired value. The actuator controllers may also send status and configuration information to antenna interface is 59 to 61 to be conveyed via control interface 50 to auxiliary equipment controller 51. This status and configuration information may be supplied to a central controller via backhaul link 54.

Figure 6:
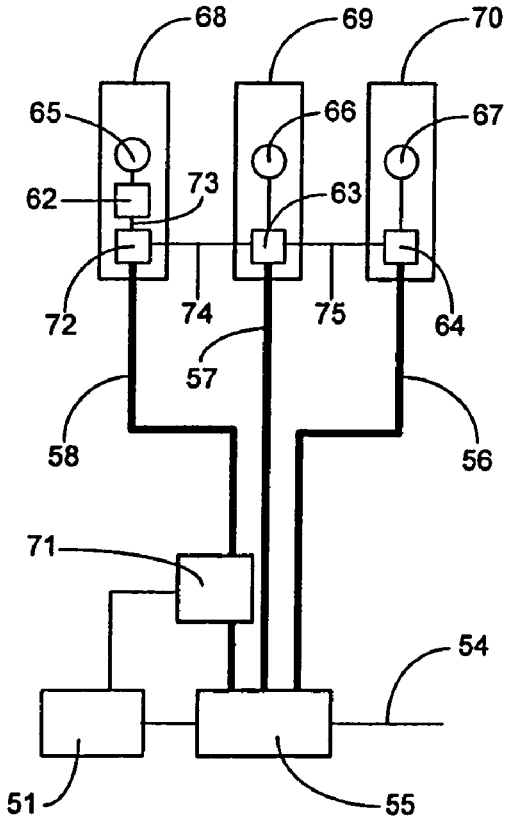
FIG. 6 shows a schematic diagram of a second data communications arrangement for the cellular base station shown in FIG. 4.

FIG. 6 shows a modified version in which like integers and have been given like numbers. In this case the control interface 71 superposes the control data only on RF line 58. An antenna interface 72 is incorporated within antenna 68 and this provides the control data to actuator controllers 62 to 64 via serial cables 73 to 75. This arrangement reduces cost by only requiring a single antenna interface 72 and for control interface 71 to interface only with one feed cable.

Figure 7:
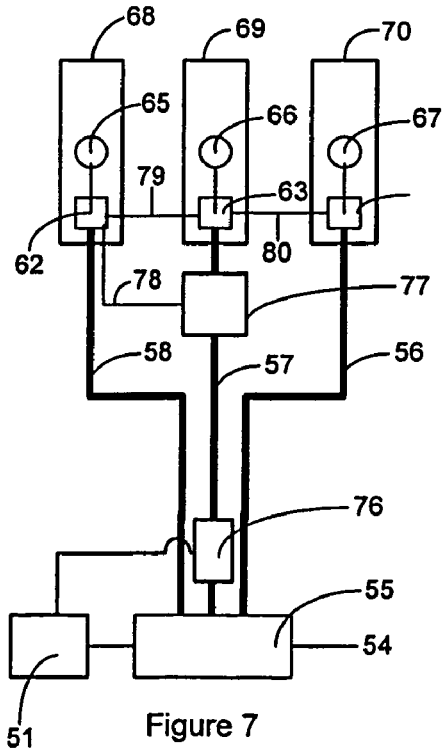
FIG. 7 shows a schematic diagram of a third data communications arrangement for the cellular base station shown in FIG. 4.

FIG. 7 shows an embodiment similar to FIG. 6 except that the antenna interface 77 is located externally to antennas 68 to 70 at the top of a tower. Actuator controllers 62 to 64 are supplied with control data via serial bus connections 78 to 80. This arrangement has the advantage that a standardized antenna unit 68 to 70 may be employed whether control data either is sent up the tower via an RF feed line or a serial cable.

Figure 8:
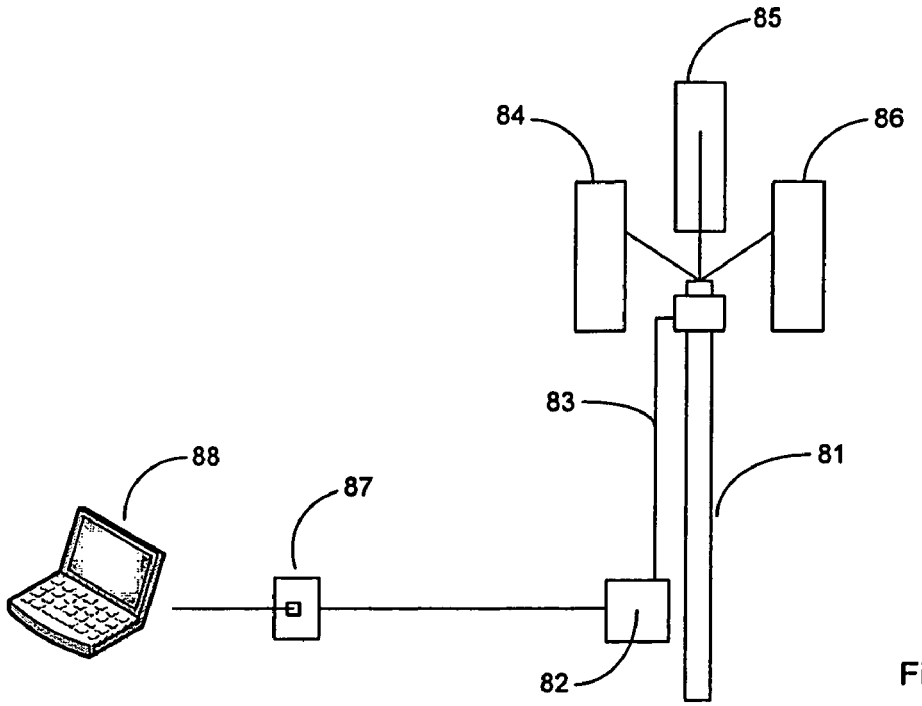
FIG. 8 shows a schematic diagram of a cellular base station in which control data is sent via a serial bus.

FIG. 8 shows an embodiment in which control data is sent up tower 81 from auxiliary equipment controller 82 via serial cable 83 to antennas 84 to 86. An access port 87 is provided to enable a portable controller (e.g. a laptop) 88 to communicate directly with auxiliary equipment controller 82 to effect local control. As shown in FIG. 9 actuator controllers 89 to 91 and auxiliary equipment controller 82 are interconnected by serial buses 83, 92 and 93. Actuators 94 to 96 are controlled by actuator controllers 89 to 91 in accordance with control data received from auxiliary equipment controller 82. Status and configuration information from actuator controllers 89 to 91 is communicated via the serial bus to auxiliary equipment controller 82.

Figure 10:
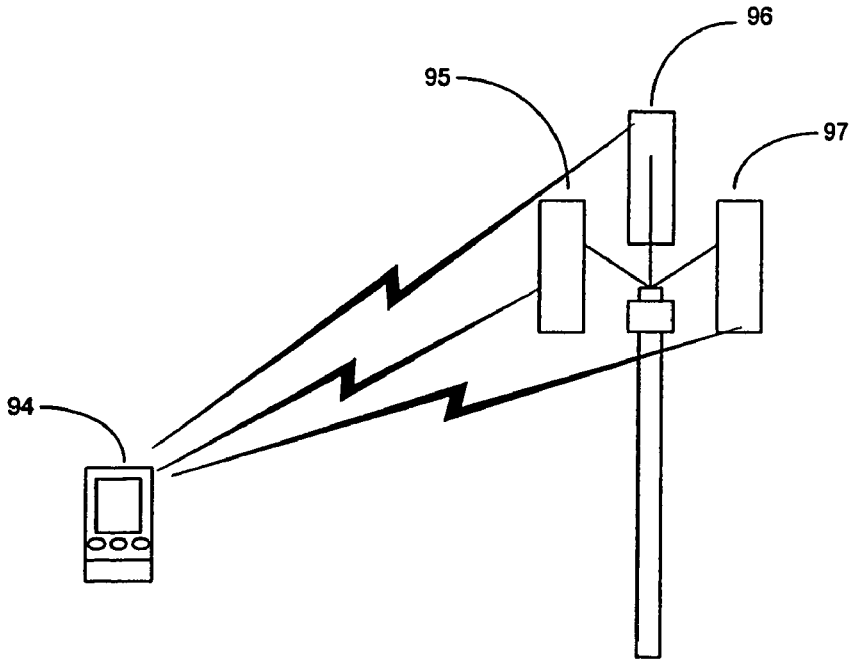
FIG. 10 shows a schematic diagram of a cellular base station in which control data is sent via a wireless link.

FIG. 10 shows a wireless embodiment in which control data is communicated between a controller 94 and antennas 95 to 97 directly via a wireless link. It will be appreciated that controller 94 may be an auxiliary equipment controller at the base station supporting wireless communication or a portable device such as a laptop with a wireless card etc. Controller 94 may also be remotely located and control antennas 95 to 97 via a long-range radio link.

Figure 11:
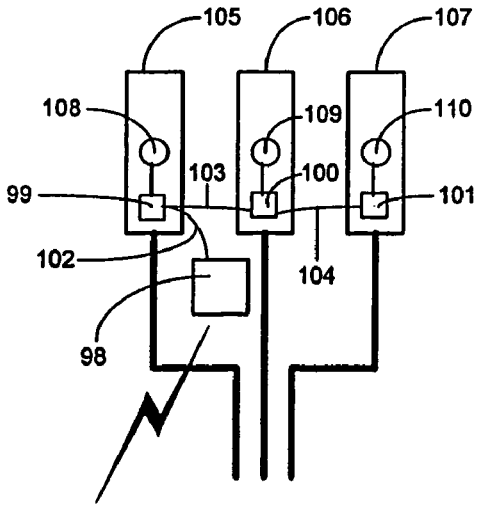
FIG. 11 shows a schematic diagram of a first data communications arrangement for the cellular base station shown in FIG. 10.

FIG. 11 shows a first embodiment in which a single antenna interface 98 communicates wirelessly with a controller 94 and communicates with actuator controllers 99 to 101 via serial bus 102 to 104 to control actuators 108 to 110. This arrangement allows standard antennas 105 to 107 having serial interfaces to be employed.

Figure 12:
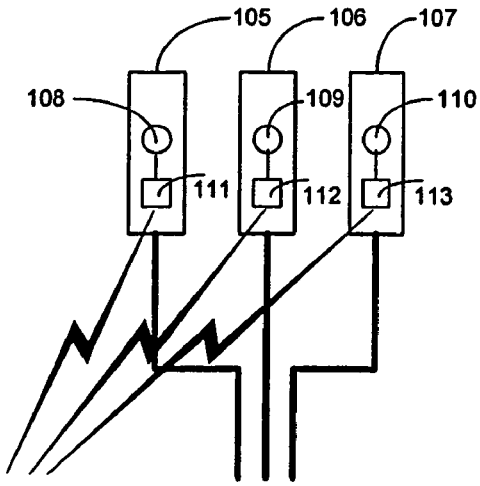
FIG. 12 shows a schematic diagram of a second data communications arrangement for the cellular base station shown in FIG. 10.

FIG. 12 shows an embodiment in which actuator controllers 111 to 113 include wireless communication circuits enabling each actuator controller 111 to 113 to communicate directly with a controller 94.

Figure 13:
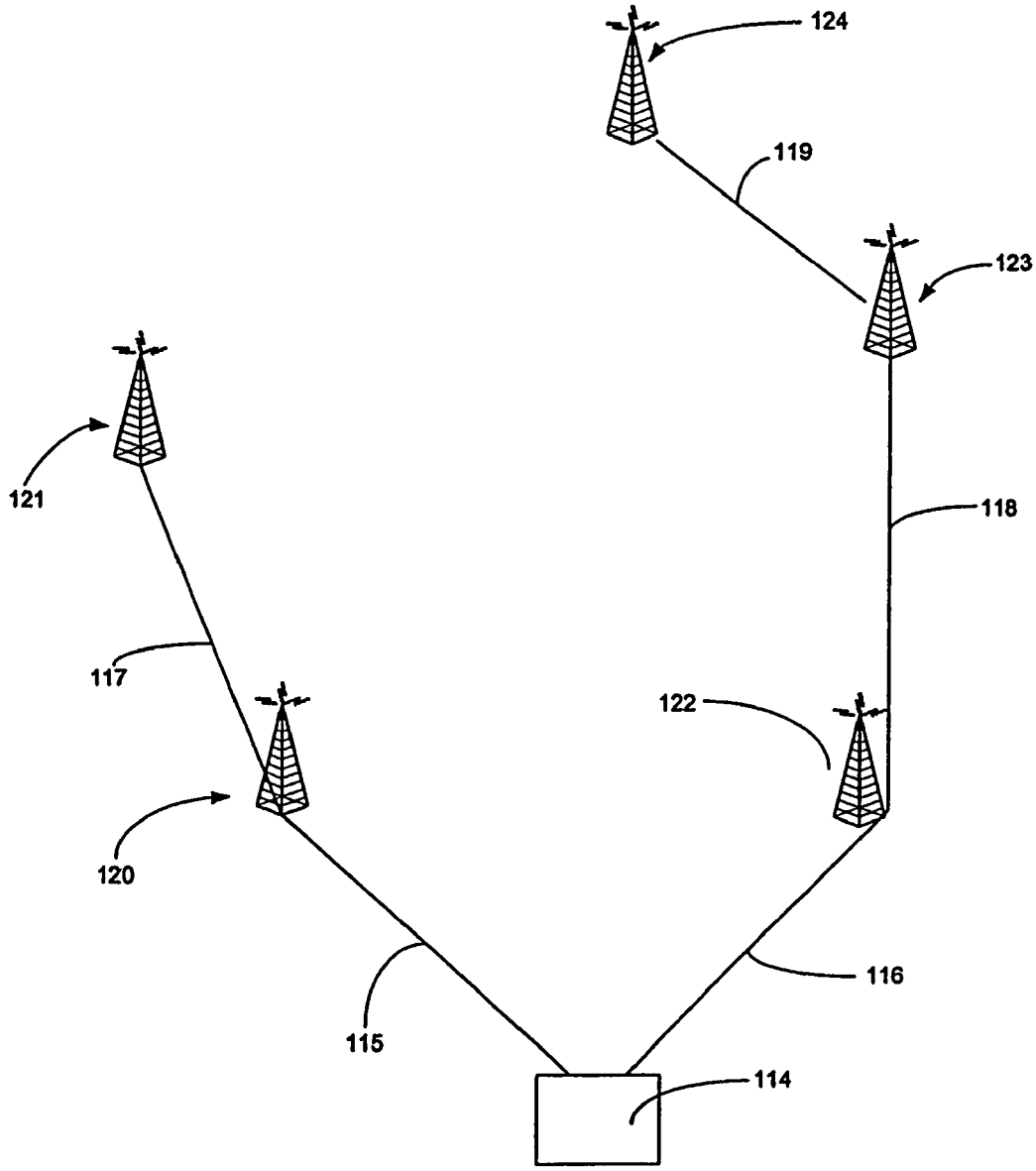
FIG. 13 shows a schematic diagram of a network management system.

FIG. 13 shows schematically a network management system in which a central controller 114 communicates via backhaul links 115 to 119 with a number of base stations 120 to 124. Central controller 114 obtains status and configuration information from each base station controller and sends control data to base stations 120 to 124. Central controller 114 may periodically receive status and configuration information and/or status and configuration information may be sent on request or whenever there is a change. Central controller 114 may adjust antenna attributes according to a schedule, on operator command or actively in response to current operating conditions (e.g. traffic demands etc).

There is thus provided an antenna providing azimuth and down tilt adjustment which maintains good radiation patterns of the antenna. A common controller enables mechanical azimuth, electrical down tilt, electrical beam width and electrical azimuth actuators to be commonly controlled. An addressable serial bus interface simplifies interconnection of antennas and controllers. Control data may be sent via an RF feed line, serial data cable or wireless connection. For multiband applications the combination of mechanical and electrical azimuth adjustment allows azimuth to be independently adjusted for two or more arrays.

Regarding azimuth adjustment of such antennas generally, by way of background, to provide adequate azimuth adjustment, plus and minus thirty degrees of rotation of the antenna is desired, for a total of sixty degrees. For a backplane of typical width, such a sixty degree rotation would cause the marginal edges of the backplane to travel about three inches forward at plus thirty degrees of rotation, and three inches back at minus thirty degrees of rotation, for a total travel of about six inches. Known mechanical components, such as actuators positioned perpendicular to a rotatable backplane would need to accommodate six inches of shaft movement. However, dimensional constraints of known antenna packaging preclude use of such an actuator arrangement perpendicular to the plane of the backplane. Further, reducing the required travel of such a shaft by moving the attachment point between the shaft and the backplane closer to the axis of rotation would cause torquing problems caused in part by increased friction. Vibration and other unwanted motion during actuation is also increased for such configurations. Accordingly, to accommodate the required components within the limited space available, the axis of the actuator and the axis of the reciprocating components must therefore be parallel or in line with the axis of the antenna in the lengthwise direction.

Figure 14:
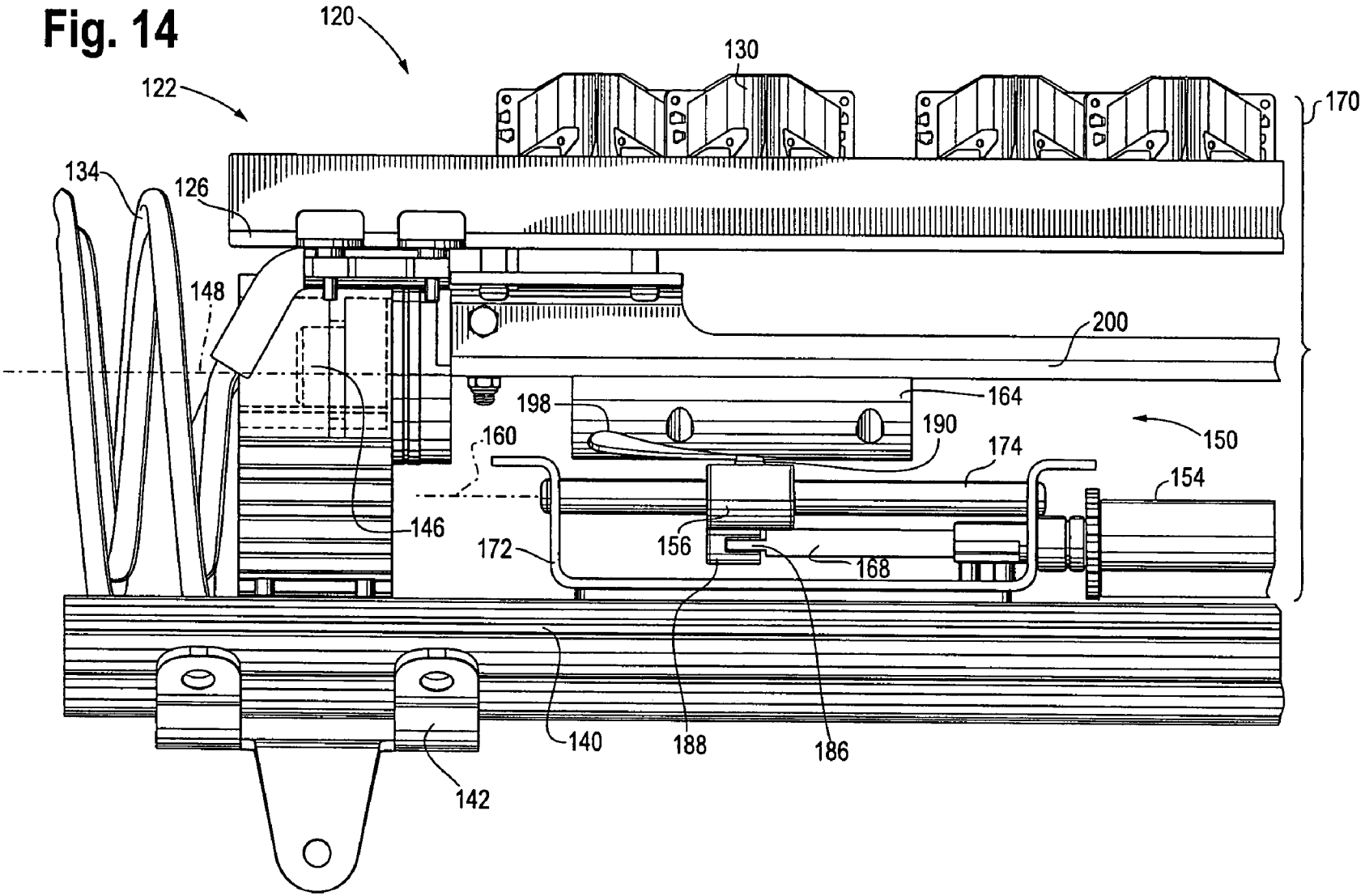
FIG. 14 shows a side elevational view of an alternate embodiment of an arrangement for providing azimuth adjustment of an array antenna for a cellular base station.

Turning now to FIGS. 14-18, FIG. 14 shows an alternate embodiment of a base station antenna 120, which may include an array antenna 122 having a reflector or planar backplane 126, upon which may be mounted a plurality of radiating elements 130, of which only four are shown in FIG. 14, and which may vary in number. Signals are fed to the various radiators 130 via cable or waveguide 134. The array antenna 122 may be mounted on an antenna frame or rigid housing 140, and the entire antenna 120 may be mounted by mounting brackets 142 to a support structure, such as a tower (not shown).

The array antenna 122 is rotatably mounted with respect to the antenna frame 140 to permit azimuth steering of the antenna beam by mechanically rotating the backplane 126 so that the beam produced by the radiating elements 130 "pans" across the horizon (at what ever elevation it is directed.). The backplane 126 may be supported by a set of bearings 146 that permit the array antenna to rotate with respect to antenna frame 140 about an antenna axis 148. Note that only the left side bearing 146 is shown.

The base station antenna 120 includes an azimuth position rotation arrangement 150, which includes several components that cooperate with each other to permit the array antenna 122 to rotate with respect to the antenna frame 140 about the antenna axis 146. The rotation arrangement 150 includes an actuator 154, which may be mounted on the antenna frame 140, and an operator 156 adapted to move linearly along an operator motion 160 axis, which is parallel to the antenna axis 148, when the actuator 154 is energized. The rotation arrangement 150 may further include a motion converter 164 operatively coupled between the actuator 154 and the array antenna 122 such that linear movement of the operator 156 along the operator motion axis 160 produces rotary movement of the array antenna about the parallel antenna axis 148, as will be explained below.

The actuator 154 is preferably an electrical actuator, but may be any suitable actuator, such as a pneumatic actuator, an hydraulic actuator and the like. Activation of the actuator 154 permits a shaft 168 of the actuator to reciprocate or move to the left or to the right, as viewed in FIGS. 14-15.

The actuator 154 is preferably controlled by a controller (not shown), which may be similar to the controllers 11, 23, 31 and 51 of the embodiments shown in FIGS. 1-7. According, the reciprocating shaft 168 may be controlled as to its direction of movement via the controller so that physical human intervention to effect positional movement is not needed.

Figure 16:
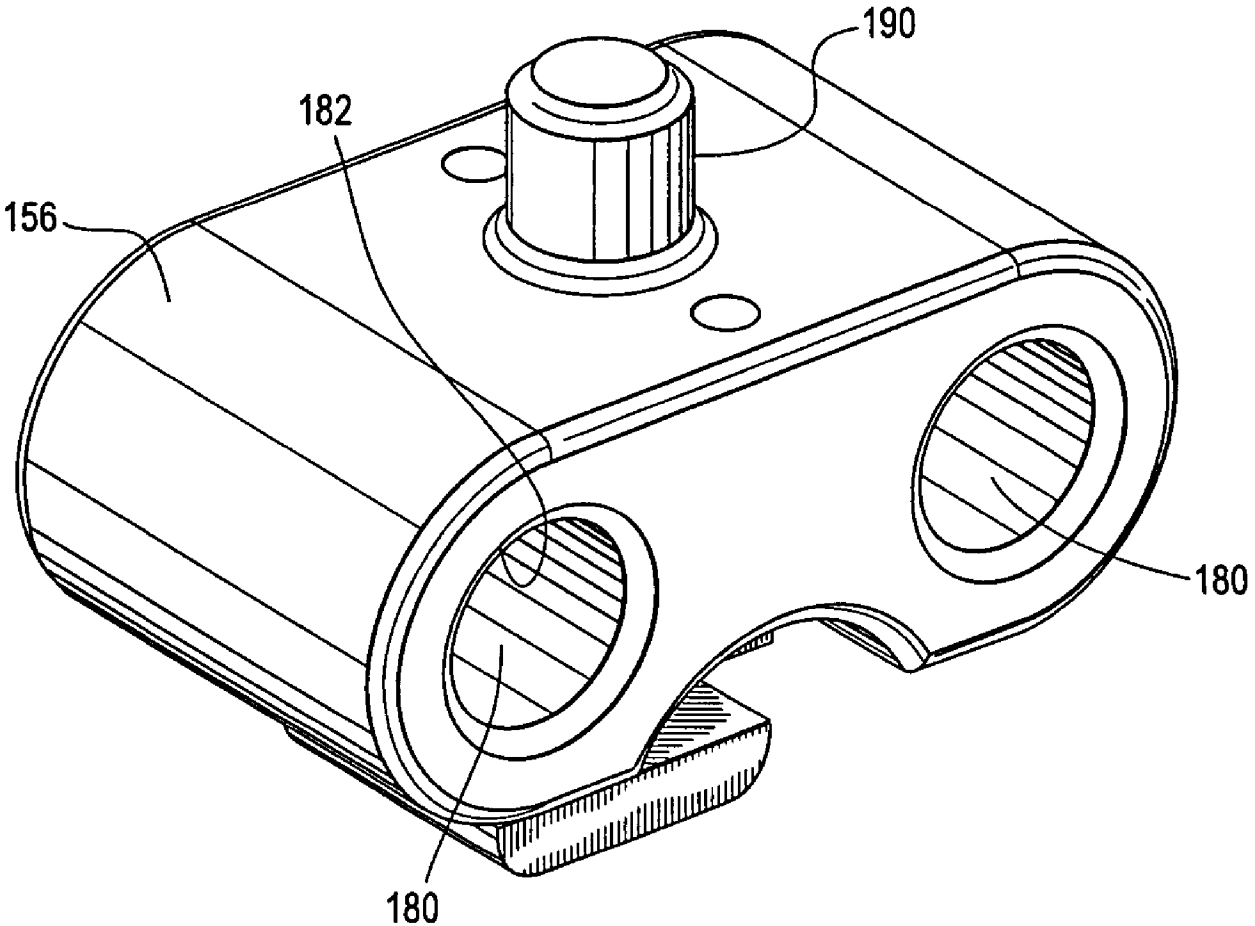
FIG. 16 shows a perspective view of an operator of FIG. 14.
Figure 17:
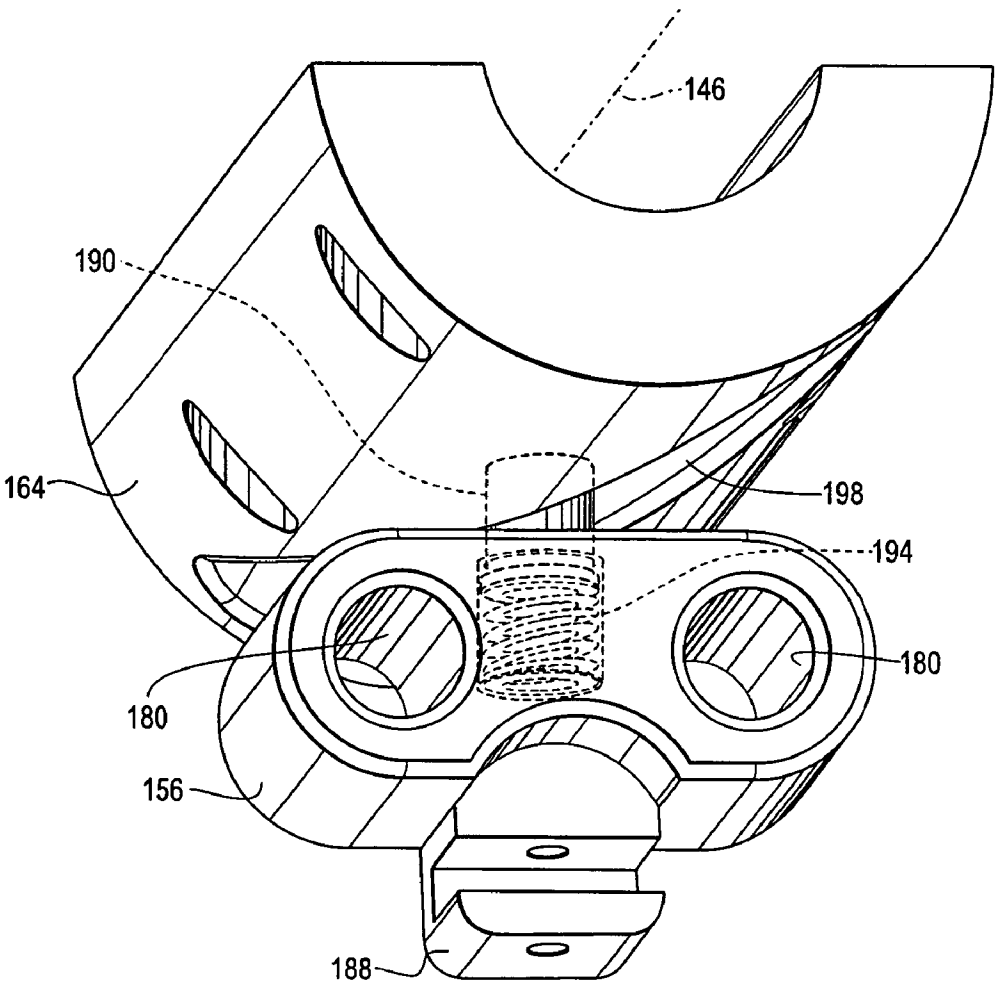
FIG. 17 shows a perspective view of the operator and cam follower coupled together.
Figure 18:
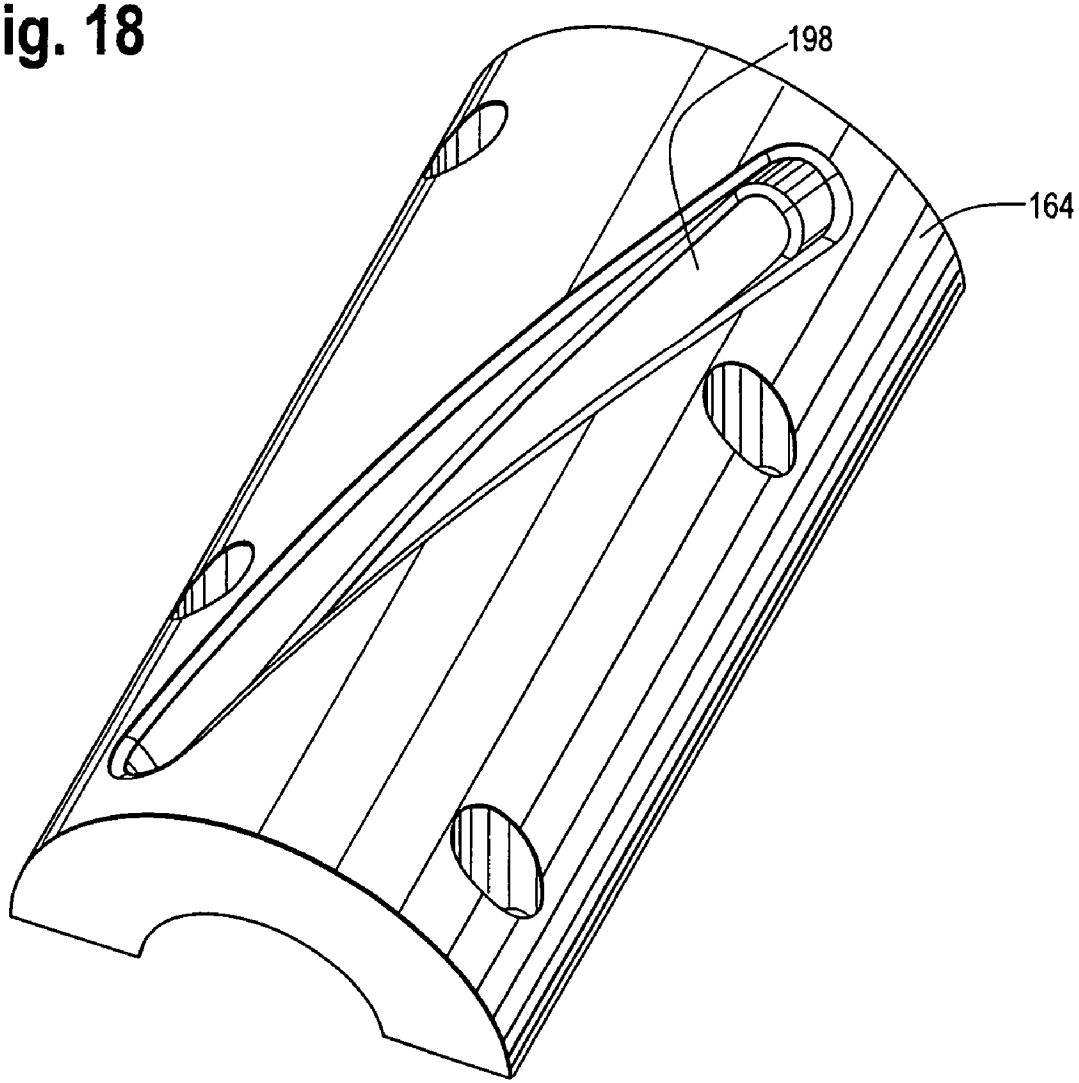
FIG. 18 shows a perspective view of the cam follower of FIG. 14.

FIGS. 16-18 show the position rotation arrangement 150, including the operator 156 and the motion converter 164, in greater detail. One feature of the present invention is that the position rotation arrangement 150 is vertically mounted and is essentially "in-line" with the axis of the antenna 120. Thus, movement of the components is also linear or parallel to the axis of the antenna and backplane 126. This is an important consideration because of dimensional constraints of the packaging. Antennas of the type described herein are typically compact to minimize any adverse aesthetic impact, as they are often placed on building or towers and visible to the public. Such antennas are typically twenty-four to forty-eight inches in length by about eight inches in depth, as measured from the edge of the radome to the back of the antenna frame, as shown by line 170 of FIG. 14. Accordingly, as described above, space is extremely limited inside the enclosure leaving typically only two inches of space behind the backplane 126 to accommodate all of the additional components.

Figure 15:
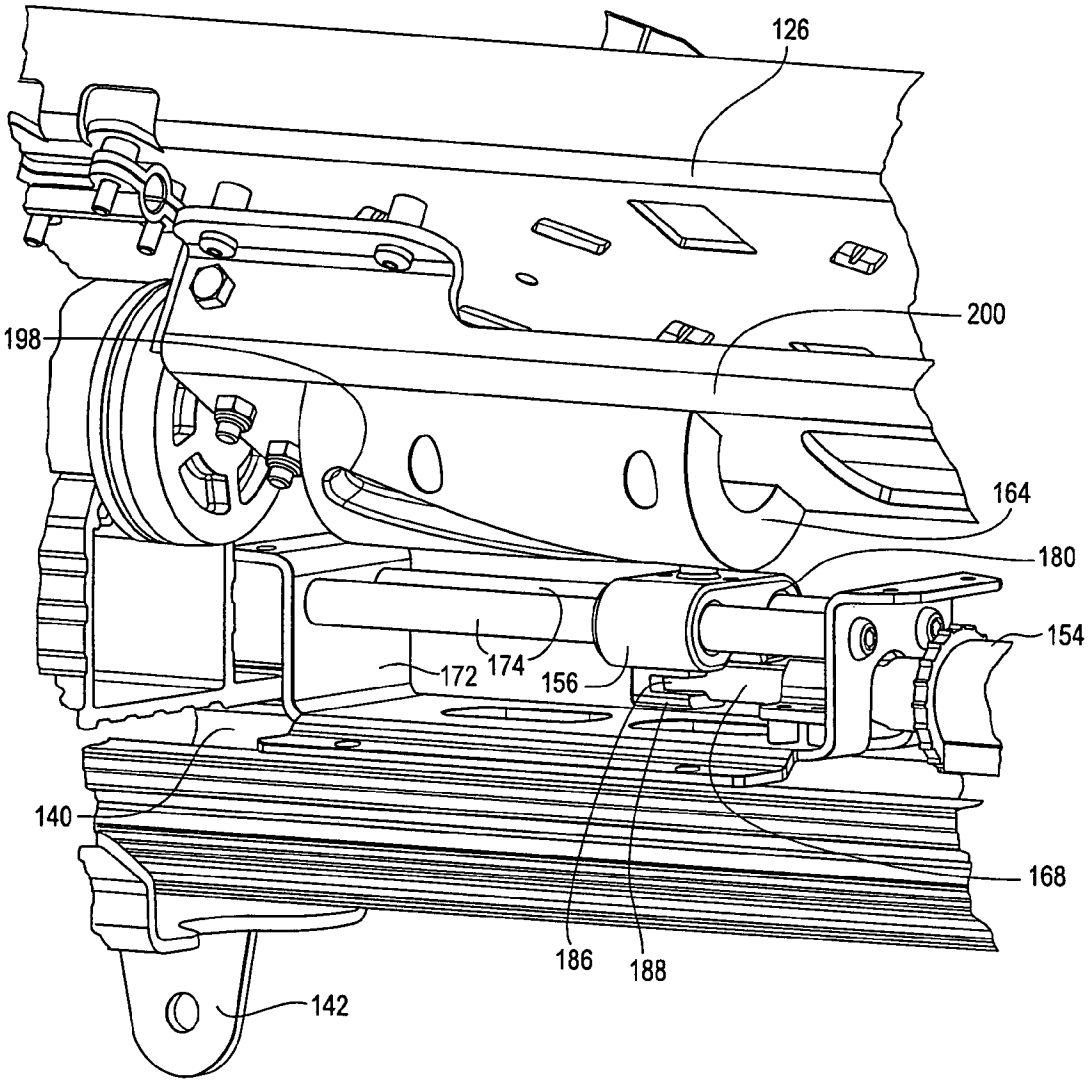
FIG. 15 shows a perspective view of the arrangement of FIG. 14.

The position rotation arrangement 150, as best shown in FIGS. 14-15 may include an elongated U-shaped bracket 172 or other structure fixed to the antenna frame 140. The bracket 172 may be fixed relative to the actuator 154 and may provide support for dual travel bars 174 fixedly mounted to the bracket. The dual travel bars 174, in turn, are operatively coupled to the operator 156, and permit the operator to slide along the dual travel bars as the reciprocating shaft 168 moves toward the left and right.

The operator 156 is shown in detail in FIG. 16 and may be in the form of a block having two throughbores 180 configured to receive the dual travel bars 174. An inside surface 182 of the throughbores may be coated with Teflon, ceramic or other coating so as to minimize friction and permit the operator 156 to smoothly slide along the dual travel bars 174 under power from the actuator shaft 168.

Alternatively, the operator 156 may have a single throughbore (not shown) operatively coupled to a single travel bar, but some other method of preventing the operator from rotating about the travel bar would be needed. For example, a groove along the length of the travel bar that mates with a corresponding inwardly radially projecting pin could prevent rotation of the operator about the travel bar. However, such an arrange could increase friction between operator and travel bar and impede linear motion of the operator if mechanical tolerances are not precise.

As shown in FIGS. 14-15 and 17, a distal end 186 of the actuator shaft 168 may be secured to a clamp-like projection 188 on the operator 156 with a bolt, rivet or other known fastener such that the operator is operatively coupled to the shaft. As best shown in FIGS. 14 and 16, the operator 156 includes a pin or stud 190 projecting from its surface. The pin 190 may have a fixed length, but preferably "floats" or is spring-loaded under bias of a spring 194 (FIG. 17) so that it is urged outwardly and away from the body of the operator a maximum distance, limited as described below. As shown in FIGS. 14-15 and 18, the position rotation arrangement 150 further includes the motion converter or cam follower 164, preferably in the form of a half-cylinder having a helical slot 198 formed therethrough configured to receive the pin 190 of the operator 156. The cam follower 164 is preferably fixedly mounted to a backplane support 200. It can be seen that when the actuator 154 is energized, the shaft 168 moves to the left or the right, which causes the operator 156 to move. Because the pin 190 engages the helical slot 198, the pin moves within the slot as the operator moves. Further, because the slot 198 is helical in pattern, it spans a portion of the circumference of the semi-cylindrical cam follower 164. Thus, linear movement of the operator 156 causes the pin 190 to exert lateral force against the wall of the slot 198, which causes the backplane support 200 and backplane 126 to rotate about the antenna axis 146. Because the cam follower 164 is adjacent the antenna axis 146, the arc of rotation of the backplane 126 is maximized.

Preferably, the helical groove 198 subtends a circumferential arc of about sixty degrees of the cam follower 164. This means that movement of the backplane 126 is also limited to sixty degrees of arc. Assuming that the backplane 126 is in a neutral position, meaning the backplane is parallel to the antenna frame 140 while the pin 190 is positioned in the middle of the slot 198, the backplane can rotate through a plus thirty degree angle and a minus thirty degree angle as the shaft 168 extends from its maximum leftward extension to its maximum rightward extension.

Note that the position rotation arrangement 150, including the actuator 154, operator 156 and dual travel bars 174, is shown mounted to the antenna frame 140 while the cam follower 164 is fixed to the rotatable backplane support 200. However, this may be reversed without departing from the scope and spirit of the invention. In that regard, the actuator 154, operator 156 and travel bars 174 may be fixedly mounted to the rotatable backplane support 200 with the cam follower fixedly mounted to the antenna frame 140, to accomplish the same function.

Figure 19:
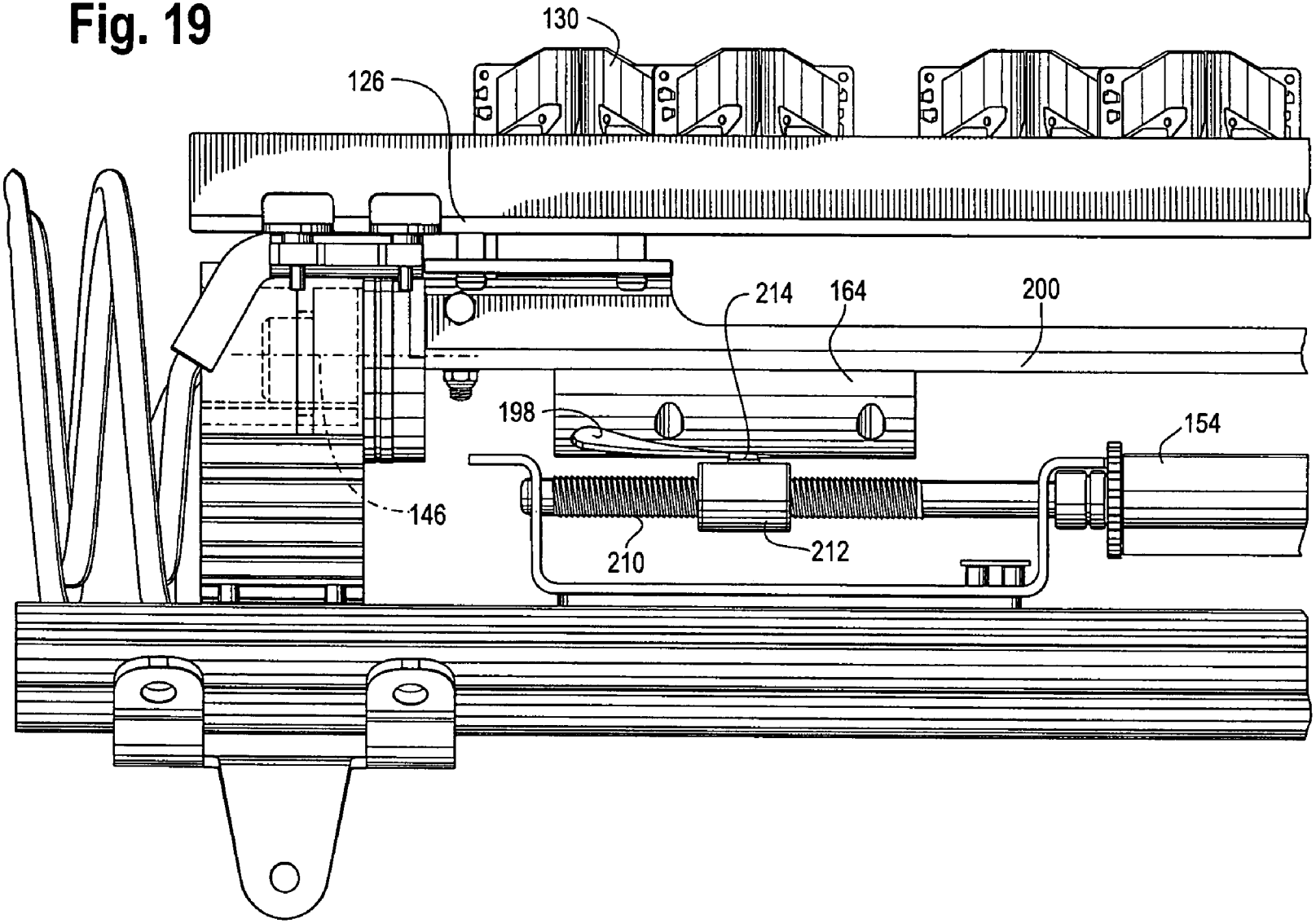
FIG. 19 shows a side elevational view of another alternate embodiment of an arrangement for providing azimuth adjustment of an array antenna for a cellular base station.

Referring now to FIG. 19, an alternate embodiment is shown, wherein the actuator 154 includes a rotary shaft 210 rather than the reciprocating shaft 168 of FIG. 14. Like reference numbers shall be used to denote like structures. The rotary shaft 210 may be threaded and coupled to a corresponding worm follower or operator 212 driven by the rotary shaft. Thus, when the actuator 154 is energized and the shaft 210 rotates, the worm follower 212 travels either to the left or right, depending upon the direction of rotation. The worm follower 212 may be similar in function to the operator 156 of FIG. 14 in that it may also include a pin 214 that cooperates with the cam follower 164. Accordingly, when the shaft 210 rotates, the worm follower 212 moves linearly, which causes the cam follower 164 to move along the helical slot 198, rally thus rotating the backplane 126 via the action of the cam follower about the antenna axis 146.

While the present invention has been illustrated by the description of the embodiments thereof, and while the embodiments have been described in detail, it is not the intention to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

What is claimed is:

1. A base station antenna system producing a beam, comprising:

an array antenna rotatably mounted with respect to an antenna support so as to permit azimuth steering of the antenna beam; and an azimuth position rotation arrangement configured to rotate the array antenna with respect to the antenna support about an antenna axis, said rotation arrangement further comprising:

an actuator mounted on said antenna support and having an operator adapted to move linearly along an operator motion axis parallel to said antenna axis when the actuator is energized;

a motion converter coupled between said actuator and said array antenna, wherein linear movement of said operator along said operator motion axis produces rotary movement of said antenna about said parallel antenna axis.

2. The antenna system of claim 1 wherein said actuator has a reciprocable shaft with an operator which reciprocates along said operator motion axis when said actuator is energized.

3. The antenna system of claim 2 wherein said motion converter includes a cam follower on said antenna which is driven by said operator.

4. The antenna system of claim 3 wherein said cam follower comprises a cylindrical shape with a helical slot which receives said operator.

5. The antenna system of claim 1 wherein the actuator is selected from the group consisting of an electrical actuator, pneumatic actuator and hydraulic actuator.

6. The antenna system of claim 1 wherein said electrical actuator includes a rotary shaft;

a worm follower driven by said rotary shaft; and wherein said worm follower reciprocates along said shaft when said actuator is energized.

7. The antenna system of claim 6 wherein said motion converter includes a cam follower on said antenna which is driven by said operator.

8. The antenna system of claim 7 wherein said cam follower comprises a cylindrical shape with a helical slot which receives said operator.

9. A base station antenna system producing a beam, comprising:

an array antenna rotatably mounted with respect to an antenna support so as to permit azimuth steering of the antenna beam; and an azimuth position rotation arrangement configured to rotate the array antenna with respect to the antenna support about an antenna axis, said rotation arrangement further comprising:

an actuator having an operator adapted to move linearly along an operator motion axis parallel to said antenna axis when the actuator is energized;

a motion converter coupled between said actuator and said array antenna, wherein linear movement of said operator along said operator motion axis produces rotary movement of said antenna about said parallel antenna axis.

* * * * *